United States Patent [19]

Philippi

[11] 4,190,248

[45] Feb. 26, 1980

[54] TROLLEY-SWING

[76] Inventor: George J. Philippi, 1209 Stillman Ave., Plainfield, N.J. 07060

[21] Appl. No.: 897,332

[22] Filed: Apr. 18, 1978

[51] Int. Cl.[2] ..... A63F 7/06

[52] U.S. Cl. ..... 272/87

[58] Field of Search ..... 272/85, 87, 88, 89, 272/90, 91, 92

[56] References Cited

U.S. PATENT DOCUMENTS

| | | | |
|---|---|---|---|
| 936,818 | 10/1909 | Schilling | 272/89 |
| 1,254,890 | 1/1918 | Douglass | 272/87 |
| 1,548,535 | 8/1925 | Lyderker | 272/85 |
| 2,083,574 | 6/1937 | Mott | 272/85 |
| 2,307,141 | 1/1943 | Ladd | 272/85 |
| 2,448,325 | 8/1948 | Poorman, Jr. | 272/85 |
| 2,510,223 | 6/1950 | Hart | 272/87 |
| 3,145,024 | 8/1964 | Grudoski | 272/87 |
| 3,391,931 | 7/1968 | Worley | 272/85 |
| 3,447,802 | 6/1969 | Grudoski | 272/87 |
| 3,674,262 | 7/1972 | Tomalinas | 272/85 |
| 3,838,854 | 10/1974 | Hendrickson | 272/85 |

FOREIGN PATENT DOCUMENTS

| | | | |
|---|---|---|---|
| 889683 | 1/1972 | Canada | 272/85 |

OTHER PUBLICATIONS

Popular Science, Jun. 1970, vol. 196, #6.

*Primary Examiner*—Richard C. Pinkham
*Assistant Examiner*—T. Brown
*Attorney, Agent, or Firm*—Martha G. Pugh

[57] ABSTRACT

A pivotally suspended trolley swing that can be propelled by the rider in both a horizontal direction and the radial direction of a normal swing. The device comprises a rigid frame which supports a trolley track at a selected height above the ground. The trolley, which is mounted for to and fro motion along the track, comprises a carrier near the front and rear ends of which are pivotally attached the upper ends of rigid hanger struts which support the swing. The hanger struts are also pivotally connected by interconnecting means at their lower ends. Seats are rigidly attached to the hanger struts. Hand holds fixed to each of the hanger struts, and foot rests on the interconnecting means, enable a swinger while seated on one of the seats, to exert manual pull and foot thrust to apply a rotational torque to the swing in a vertical plane.

4 Claims, 4 Drawing Figures

TROLLEY-SWING

BACKGROUND OF THE INVENTION

This relates in general to recreational devices comprising swings; and more particularly, to a swing combining the motions of rotation in a vertical plane with translation in a horizontal plane, wherein the device is rider-propelled.

A variety of recreational equipment for producing swings with traveling and pivotal movement have been proposed, such as disclosed, for example, in U.S. Pat. Nos. 1,548,535 to J. G. Lydecker; 2,083,574 to G. T. Mott; 2,307,141 to E. W. Ladd; 2,448,325 to C. B. Poormen, Jr.; 3,391,931 to W. J. Worley; 3,674,262 to W. R. Tomalinas, Jr.; and 3,838,854 to W. H. Hendrickson.

Of the foregoing, the device disclosed by Lydecker is not a free traveling ride, but moves over a toothed track. The device disclosed by Mott provides a load-supporting surface which is alternately concave and convex in continuous convolutions. The remaining disclosed devices all have a flexible rope or chain type swing attached to the traveling trolley, therefore, requiring a second non-riding parent or playmate to put the unit in operation.

BRIEF DESCRIPTION OF THE INVENTION

It is therefore the principal object of the present invention to provide a trolley-swing which can be operated by a single rider without the assistance of a non-riding parent or playmate.

This and other objects are realized in the trolley-swing of the present invention which comprises a straight track supported on top of a rigid frame, a trolley mounted to move to and fro on the track, and a swing supported by rigid hanger struts suspended from upper pivot points spaced apart on the trolley carriage. The hanger struts are connected together at their lower ends through a pair of lower pivot points to form a parallelogram which takes the form of a rectangle in its vertical rest position. Twin seats, hand-holds and foot-rests rigidly fastened at symmetrical positions near the lower ends of the swing supporting struts enable a rider sitting in one of the seats by manual pull and foot thrust to exert a torque on the parallelogram comprising the supporting hanger struts. This causes rotation of the swing about the upper pivot points, raising the center of mass radially above its at-rest position, and causing it to store up potential energy which is translated into kinetic energy when the swing responds to the pull of gravity returning towards its rest position. As the swing passes through the rest position on its return swing, it drags the trolley with it, causing the trolley to move to the end of the track, where it meets with resistance to further horizontal travel and the pendulum or radial swing excursion is completed. At the peak of this radial excursion pressure is re-applied to the hand holds and foot rests and the excursion is repeated in the opposite direction. Each time the swing reaches the peak of its radial excursion, the rider reinforces the motion. If there are two or more riders, they cooperate, each inducing or reinforcing the motion in an opposite direction. Left and right shock absorbers located at the track ends cushion the impact of the trolley ride.

The principal advantage of this ride is that it is propelled by the efforts of the rider himself, without the necessity for a parent or play-mate to act as a pusher. Further, two or more riders can cooperate in propelling the swing. Further, it provides a sturdy, safe ride, in which the rider has a foot rest, and is less likely to fall out than in the ordinary swing. These, and other objects, features and advantages will be better understood by a study of the drawings, and the detailed description hereinafter.

SHORT DESCRIPTION OF THE DRAWINGS

Figure 1:
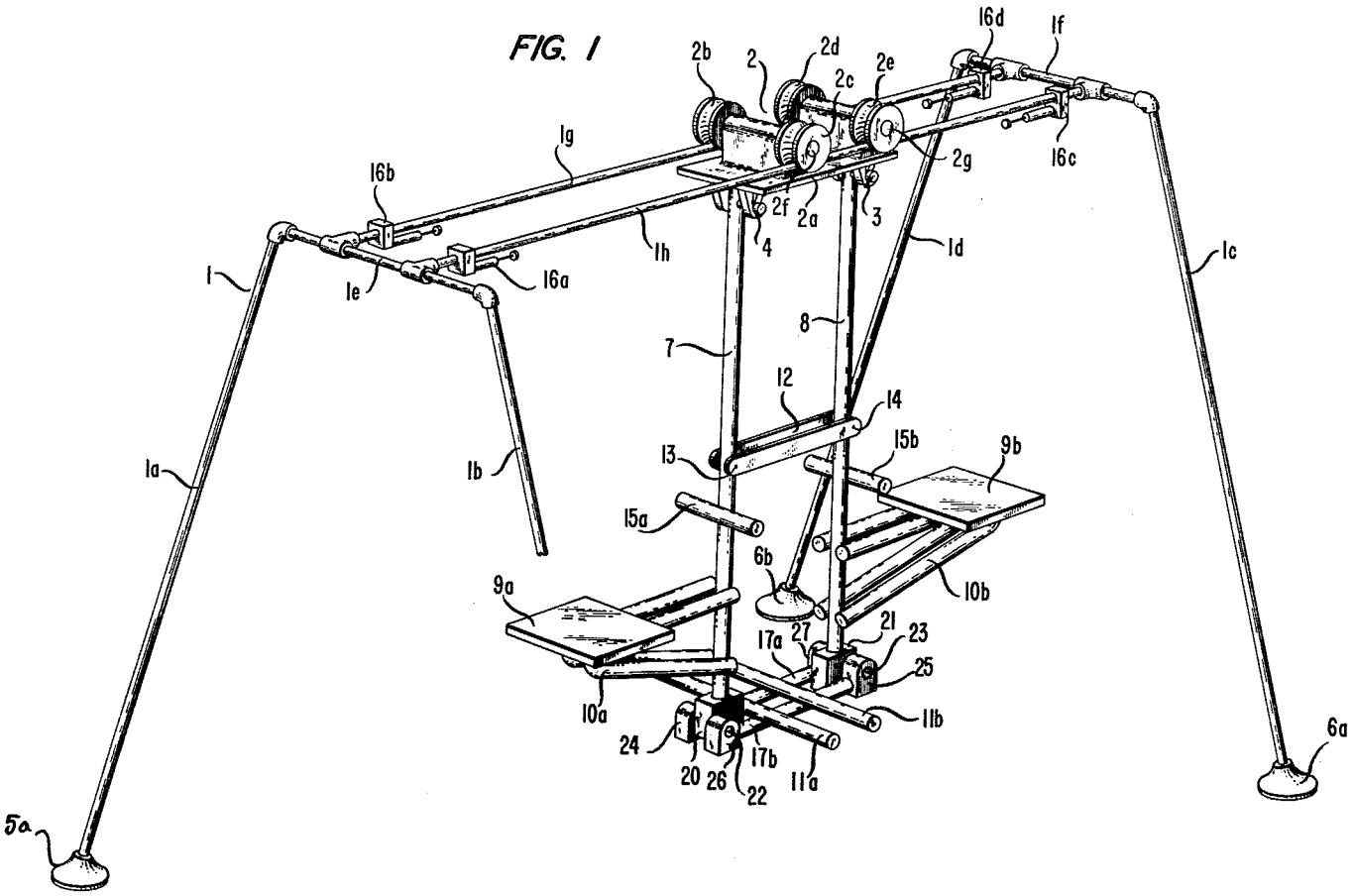
FIG. 1 is a perspective view of the combination swing and trolley ride of the present invention.
Figure 4:
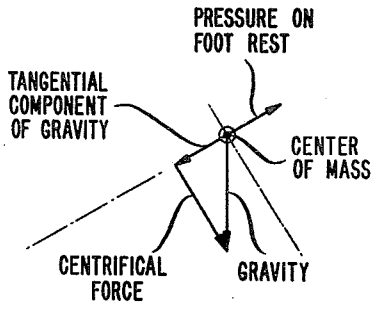
Figure 3:
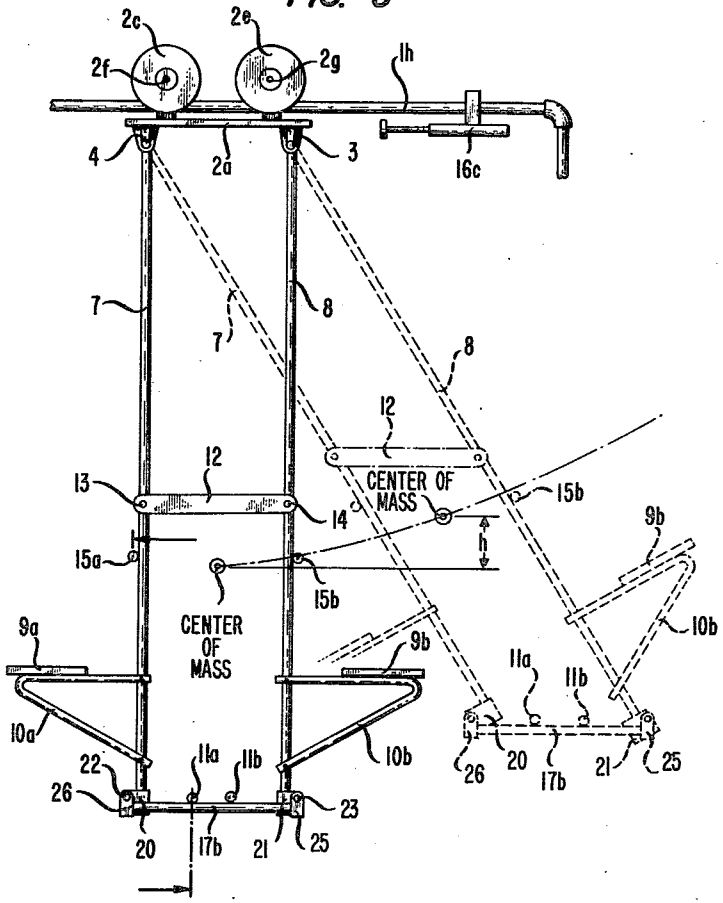
Figure 2:
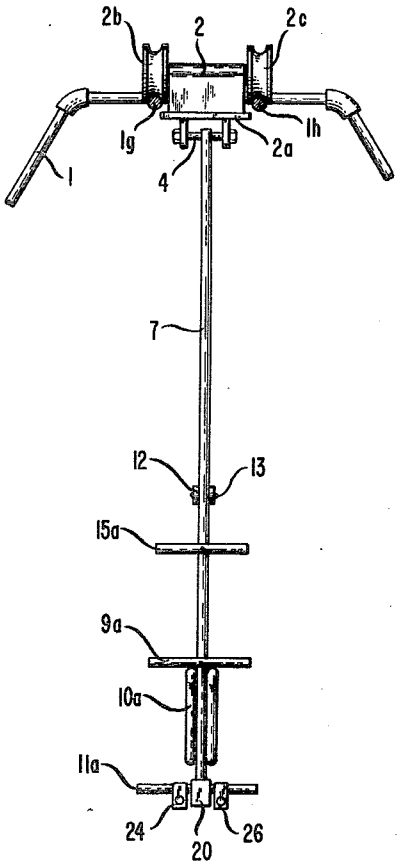
FIG. 2 is an end elevational view of the swing and trolley ride of FIG. 1, with portions of the supporting frame broken away.

FIG. 3 is a side elevational view of the swing and trolley ride of FIG. 1, with the swing shown in full lines in rest position, and in phantom in an alternate position in which the swing is deflected to the right of rest position; and FIG. 4 is a force diagram showing the vertical and horizontal force components as they act on the center of mass in the swing and trolley ride shown in FIGS. 1 through 3.

DETAILED DESCRIPTION OF THE INVENTION

Referring in detail to FIG. 1, the supporting frame 1 is formed, of steel tubing, wood or any other rigid structural material. This comprises four inclined corner posts 1*a*, 1*b*, 1*c*, and 1*d*, which for stability, may be mounted in two pairs of foot pads 5*a*, 5*b* (not shown), and 6*a*, 6*b*. The corner posts 1*a*, 1*b*, 1*c*, and 1*d*, are designed to support at their respective upper ends a pair of horizontal bars 1*e* and 1*f* at a height of, say, 8 feet above ground level. The transverse bars 1*e* and 1*f* act as supports for the parallel tracks 1*g* and 1*h* which are shown spaced apart horizontally for stability of the trolley. Stability of the trolley may also be achieved by spacing the tracks 1*g* and 1*h* apart in a vertical or other plane. These tracks are disposed in symmetrical parallel relation, and are long enough to provide a horizontal ride of about 6 or 8 feet, possibly more.

Parallel bars 1*g*, 1*h* serve as tracks for the wheels of the trolley 2. This comprises an undercarriage 2*a*, which supports on its upper surface a pair of transversely-disposed bearing members, in which are mounted, in parallel relation, front and rear axles 2*f* and 2*g*. Rotatably mounted on their respective opposite ends are the groove wheels, 2*b* and 2*c* on the front, and 2*d* and 2*e* on the rear. The wheels 2*b* and 2*d* ride on the rail 1*g*; and the wheels 2*c* and 2*e* ride on the rail 1*h*.

Although in the present example as shown in FIG. 1 et seq., the double tracks are spaced apart horizontally for stability of the trolley, it will be understood that in a modified form, with stability accomplished by vertical spacing of the two tracks, only two load carrying wheels would be required on one of the tracks with a pair of stabilizing wheels or guides on the other track. In accordance with another alternative, a monorail system could also be substituted accomodating a trolley with only one or two wheels.

Shock absorbers 16*a*, 16*b* are mounted on each of the rails 1*g*, 1*h* at the terminals on one side, whereas shock absorbers 16*c*, 16*d* are mounted on the opposite terminals. These tend to make a smoother trolley ride, and to deaden the impact as the trolley comes in contact with the terminals at the end of its swing.

FIGS. 2 and 3 of the drawings show, in side elevation and end elevation, respectively, the wheels of the trolley 2 riding on the rails 1*g* and 1*h* of the frame 1. The swing is supported from the underside of the trolley carriage 2*a* by a pair of depending rigid supporting hanger struts 7 and 8, the upper ends of which are bored and mounted for rotation about a pair of upper pivot pins 3 and 4, so that they are rotatable in a vertical plane along the longitudinal axis of the carriage 2*a*, in the principal track direction. Upper pivot pins 3 and 4 are respectively mounted in brackets which depend from the rear and front ends of the carriage 2*a*, so that the pins extend laterally in a direction normal to the principal direction of the rails 1*g* and 1*h*.

In the present example hanger struts 7 and 8 preferably are formed of metal tubing, but may be made of wood or any other rigid structural material. About half-way below their upper ends, supporting hanger struts 7 and 8 are joined together by a transverse strut 12, also preferably of metal. Strut 12 is rotatably connected near its opposite ends to the hanger struts 7 and 8 by means of a second pair of middle pivot pins 13 and 14.

The hanger struts 7 and 8 terminate at their lower ends in a pair of blocks 20, and 21 which have transverse bores serving as bearings for the lower pivot pins 22 and 23, which serve to couple hanger struts 7 and 8 to the rigid interconnecting bars 17*a* and 17*b*, which are disposed in parallel relation, transverse to 7 and 8. 17*a* and 17*b* are preferably made of metal tubing, but may be made of wood or any other rigid structural material. The opposite ends of 17*a* and 17*b* are rigidly fastened in the metal blocks, 24 and 26 on one side, and 25 and 27 on the other side. The blocks 24 and 26 act as supports for the two ends of the lower pivot pin 22, on opposite sides of the block 20; whereas the blocks 27 and 25 act as supports for the two ends of the lower pivot pin 23, on opposite sides of the block 21. Thus, the hanger struts 7 and 8 are disposed in rotatable relation in a vertical plane about pins 22 and 23, forming with the hanger struts 17*a*, 17*b* a parallelogram, the angles of which are distorted as the swing moves in a vertical plane.

Rigidly disposed in fixed parallel relation, normal to the interconnecting rods 17*a*, 17*b*, are a pair of foot-rests 11*a* and 11*b*, which are welded or bolted in place about 10 inches apart. These are, say, about 18 inches in length, and may be of the same material as the interconnecting rods 17*a*, 17*b*.

A pair of flat, wooden slats 9*a*, and 9*b*, which function as seats, are respectively supported by the laterally-extending brackets 10*a* and 10*b*, rigidly fixed to the respective depending hanger struts 7 and 8, so that the seats 9*a*, and 9*b* extend out normally in opposite directions from the supporting hanger struts 7 and 8. Although, in the embodiment illustrated in FIG. 1 et seq., the brackets 10*a* and 10*b* are rigidly fixed to the respective depending hanger struts 7 and 8, it will be understood that provision may be made by a series of alternative mounting holes in hanger struts 7 and 8, or clamps on brackets 10*a* and 10*b*, of a form well-known in the art, permitting adjustment of the seat elevation relative to the foot rests.

Rigidly fixed to each of the supporting hanger struts 7 and 8 in a plane about 1½ feet above the plane of seats 9*a*, 9*b*, or in such a position that they may easily be grasped by a rider, are a pair of hand-holds 15*a*, 15*b*. These may be of metal tubing or of any of the other substantially rigid structural materials used for the hanger struts 7 and 8. Hand-holds 15*a*, 15*b* are welded, bolted, or otherwise secured normal to the respective opposite sides of the hanger struts 7 and 8, so as to be in symmetrical parallel relation to one another.

Although in the present example a single rectangular structure comprising hanger struts 7, 8 and bars 17*a* and 17*b* is suspended from the trolley providing seats for two riders, it should be understood that two such exactly matching rectangular structures might be suspended from the trolley in laterally spaced-apart positions, in the manner of the old-fashioned lawn swings. These two exactly matching rectangular structures could then be connected rigidly with bench-type seats that could accommodate four or more riders instead of two.

DESCRIPTION OF THE OPERATION

It will be noticed from the geometry of FIG. 3, that the upper and lower pivots 3, 4 and 22, 23 connected by the lateral rigid members 7 and 8, and by the lower interconnecting members 17*a*, 17*b* form an unstable parallelogram which provides the mechanism enabling the swing of the present invention to be propelled without auxiliary help, as will be shown In operation of the swing, a single rider, sitting, for example, in left-hand seat 9*a*, can by pushing on the left-hand foot-rest 11*a* while pulling on the left-hand hold 15*a*, thereby producing a force couple as shown by the arrows of FIGS. 3 and 4. This couple will distort the unstable parallelogram about the pivot pins 3, 4 and 22, 23, forcing it to assume a position such as shown in phantom in FIG. 3. This initial distortion will take place without any lateral movement of the center of mass of the suspended system, because as yet there is no outside force to make it move laterally. In other words, the trolley will pivot about the center of mass in a direction opposite to the direction of the lower extremity of the swing, thereby maintaining the lateral position of the center of mass.

However, although the center of mass does not move laterally during this initial movement, it does rise radially by a distance "h" (see FIG. 3). The vertical distance "h" which is a source of potential energy to the system, will depend in magnitude upon the pressure exerted on the appropriate ones of the hand-holds 15*a*, 15*b* and the foot-rests 11*a*, 11*b*. The center of mass will rise radially until the tangential component of gravity equals the pressure on the appropriate foot-rest, as shown in FIG. 4.

When this point of maximum height is reached, the rider merely relaxes pressure on the appropriate foot-rest 15*a*, or 15*b*, and the swing will start to return to its natural vertical position. At this point, the potential energy due to the elevation "h" is transformed into kinetic energy or momentum. The energy in the system is sufficient to carry the swing past its natural vertical rest position; however, on reaching the rest position, the swing does not have a fixed fulcrum, or pivot point, in the manner of an ordinary swing; but instead of continuing to swing backward in the manner of a pendulum, it pulls the trolley along with it. When the trolley meets resistance at the track terminal, the pendulum or swing excursion is completed.

At the apex of the swing to the left, the whole procedure is repeated; that is, pressure is reapplied to the appropriate one of foot-rests 11*a*, 11*b*, and the appropriate one of hand-holds 15*a*, 15*b* is pulled. At first, with the trolley held stationary against the left-hand terminal, the swing will again fall or swing down toward the vertical position. Again, upon reaching the vertical rest position, the inertia of the swing will carry the trolley along with it until the trolley reaches the right-hand terminal. At this position, the swing will continue its pendulum motion until it again reaches a position similar to that shown in phantom in FIG. 3. This can be repeated indefinitely until the rider is worn out.

The example described assumes a single rider; however, it should be apparent that two or more riders can operate the device in tandem, the riders on each side reinforcing the motion in an opposite direction.

It will be understood that the present invention is not limited to the specific structural form, components, or materials shown herein by way of example, but only by the scope of the appended claims.

What is claimed is:

1. A trolley-swing comprising in combination:

a rigid frame constructed to support an elongated track at a height above and in substantially parallel relation to ground level;

a trolley, including a carriage, mounted for extended to and fro motion along said track;

a swing comprising at least one forward and one rear supporting hanger strut mounted with the upper ends of each said hanger strut respectively disposed in rotatable relation to forward and rear upper pivot means;

said forward and rear upper pivot means supported in spaced-apart relation along said carriage in the principal direction of said track so that in their vertical rest positions said hanger struts depend from said carriage in parallel vertical relation, forming two sides of a parallelogram;

the horizontal component of the rotation of said hanger struts being substantially aligned with the principal direction of said track;

interconnecting means being connected between the lower ends of said hanger struts through forward and rear lower pivot means, said interconnecting means forming a third side of said parallelogram which is substantially parallel to the carriage of said trolley;

at least one seat for a rider of said swing rigidly connected intermediate the end of at least one said hanger strut exclusive of said interconnecting means;

and means respectively responsive to manual pull and foot-thrust by a rider seated on said at least one seat for applying a torque to distort the angles of said parallelogram comprising said hanger struts, to cause rotation thereof in a vertical plane about said upper and lower pivot means, from said vertical rest position to a position of rotational displacement and to convert a component of the rotational motion of said hanger struts to translational motion of said trolley carriage along said track as said hanger struts pass through their vertical rest position in returning from a position of rotational displacement;

said means responsive to manual pull and foot-thrust comprising a hand-hold rigidly connected at an intermediate position on said one hanger strut, and a footrest disposed on said interconnecting means adjacent said one hanger strut.

2. The combination in accordance with claim 1 which includes an additional interconnecting bar pivotally mounted with one end on each of said hanger struts in a position above said at least one hand-hold, said bar being substantially normal to the principal axes of said hanger struts in depending rest position.

3. The combination in accordance with claim 1 wherein said at least one seat comprises:

a pair of seats for riders of said swing rigidly connected in symmetrically-disposed positions opposite one another on said hanger struts above said interconnecting means;

and wherein said means respectively responsive to manual pull and foot-thrust by one or more riders seated on one or more of the seats of said pair, comprises a pair of hand-holds rigidly connected at symmetrical intermediate positions on said hanger struts, and a pair of foot-rests symmetrically disposed on said interconnecting means adjacent the base of each of said hanger struts.

4. The combination in accordance with claim 1:

wherein said at least one forward and one rear hanger struts comprise two forward and two rear hanger struts, and wherein the upper ends of said hanger struts are respectively disposed in rotatable relation to the said forward and rear pivot means;

said forward pivot means constructed to support said forward hanger struts in a spaced-apart relation along the front of said carriage, lateral to the principle direction of said track, and said rear pivot means constructed to support said rear hanger struts in spaced-apart relation along the rear of said carriage, lateral to the principle direction of the track, so that in the vertical position, said forward and rear hanger struts depend from said carriage in parallel vertical relation forming two sides of two matching parallelograms, the horizontal component of rotation of said hanger struts being substantially aligned with the principle direction of said track;

said interconnecting means being respectively connected between the lower ends of said hanger struts through said forward and rear lower pivot means, said interconnecting means forming the third sides of two matching parallelograms which are substantially parallel to the carriage of said trolley;

said at least one seat comprising a first and a second bench-type seat, each for two or more riders of said swing, said first bench-type seat being rigidly connected to said forward pair of hanger struts, and said second bench-type seat being rigidly connected to said rear pair of hanger struts;

and said means respectively responsive to manual pull and foot thrust by the riders seated on said first and second bench-type seats comprising said hand holds and said foot rests respectively disposed to apply a torque to distort the angles of said matching parallelograms comprising said hanger struts to cause rotation thereof in a vertical plane about said upper and lower pivot means.

* * * * *